US008100487B2

(12) United States Patent
Liang et al.

(10) Patent No.: US 8,100,487 B2
(45) Date of Patent: Jan. 24, 2012

(54) AUXILIARY POSITIONING DEVICE FOR SLIDE ASSEMBLY

(75) Inventors: Hsiu-Chiang Liang, Kaohsiung Hsien (TW); Ken-Ching Chen, Kaohsiung Hsien (TW); Chun-Chiang Wang, Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 245 days.

(21) Appl. No.: 12/626,755

(22) Filed: Nov. 27, 2009

(65) Prior Publication Data

US 2011/0129172 A1 Jun. 2, 2011

(51) Int. Cl.
*A47B 88/04* (2006.01)

(52) U.S. Cl. ..... 312/333; 312/319.1

(58) Field of Classification Search ..... 312/330.1, 312/334.1, 334.7, 334.8, 333, 334.44, 334.46, 312/334.47, 319.1; 384/20, 21, 22
See application file for complete search history.

(56) References Cited

U.S. PATENT DOCUMENTS

| | | | | |
|---|---|---|---|---|
| 5,040,833 | A * | 8/1991 | Brunnert | 292/80 |
| 5,207,781 | A * | 5/1993 | Rock | 312/319.1 |
| 7,815,267 | B1 * | 10/2010 | Frousiakis | 312/333 |
| 2004/0237252 | A1 * | 12/2004 | Hoshide et al. | 16/72 |
| 2005/0104492 | A1 * | 5/2005 | Chiu | 312/333 |
| 2008/0231156 | A1 * | 9/2008 | Hoshide et al. | 312/334.46 |
| 2009/0115300 | A1 * | 5/2009 | Chen et al. | 312/334.1 |

* cited by examiner

*Primary Examiner* — James O Hansen
(74) *Attorney, Agent, or Firm* — Rosenberg, Klein & Lee

(57) ABSTRACT

A slide assembly with an auxiliary positioning device includes a positioning member and a guiding base. The positioning member is pivotally connected to a first slide member and includes a pin member. The guiding base is connected to a second slide member and includes a separation body, an engaging body, multiple passages and slots. When the second slide member is retracted, the pin member is located in a first passage. When the second slide member is pushed inward, the pin member moves from the first passage into a first slot. When the force is released, the pin member moves through a second passage and the second slide member pops out. When the second slide member is retracted again, the pin member is engaged with the engaging body and then disengaged from the engaging body by a pushing force, the pin member moves through a third slot and a third passage.

14 Claims, 20 Drawing Sheets

AUXILIARY POSITIONING DEVICE FOR SLIDE ASSEMBLY

FIELD OF THE INVENTION

The present invention relates to an auxiliary positioning device, and more particularly, to an auxiliary positioning device for a slide assembly to control the slide assembly to be positioned by operation of the auxiliary positioning device when the slide assembly is to be closed.

BACKGROUND OF THE INVENTION

U.S. Pat. No. 5,040,833 to Brunnert discloses a "Closing Device For Drawers", which includes a drawer installed to a furniture body. The drawer is movable between a closed position and an open position, as shown in FIGS. 2-6, 18*a* and 18*b* of U.S. Pat. No. 5,040,833. A spring is located between the drawer and the furniture body. A holding member is fixed to the furniture body and has a front end. A latch member is fixed to the drawer and includes a first raised area and a second raised area, wherein the second raised area includes a notch which is located corresponding to the first raised area. The second raised area further includes an inclined guide track. When the drawer is located at the closed position relative to the furniture body, the front end of the holding member is guided by the inclined guide track of the second raised area to be engaged with the notch of the second raised area. When the drawer applies a force relative to the furniture body, the front end of the holding member is guided by the guide track of the first raised area to be engaged with another guide track and is disengaged from the notch. The drawer is pushed by the force of the spring and moved to a self-opening position relative to the furniture body.

The front end of the holding member is in a free status when the drawer is opened relative to the furniture body and the holding member is disengaged from the latch member. In this status, when the drawer is pushed to its closed position, the drawer can only travel through the same processes to let the front end of the holding member engage with the notch of the latch member.

However, if the demand is that the holding member and the latch member do not have a locked relationship when the drawer is located at the close status, especially when the drawer has a self-closing function. The relationship between the holding member and the latch member has to be changed. The present invention provides an improved structure to include the functions which the conventional closing device does not have.

SUMMARY OF THE INVENTION

The present invention relates to a slide assembly with an auxiliary positioning device and comprises a first slide member and a second slide member which is longitudinally and slidably movable relative to the first slide member. The second slide member has a stored opening force relative to the first slide member when in a closed position. The auxiliary positioning device comprises a positioning member, a guiding base and a link member. The positioning member is pivotally connected to the first slide member and includes a pin member. The guiding base is attached to the second slide member and comprises a first passage, a first slot and a first wall, wherein the first wall has a first guide surface facing the first passage. The guiding base further comprises a second passage, a second slot and a second wall, wherein the second wall has a second guide surface facing the second passage.

The guiding base further comprises a separation body having a guiding end which faces the first slot. The guiding base further comprises an engaging body having an engaging surface which has a portion facing the second slot. The guiding base further comprises a third passage, a third slot and a third wall, wherein the third wall has a third guide surface facing the rest portion of the engaging surface. The guiding base further comprises a fourth wall having a fourth guide surface. The link member is located corresponding to the positioning member.

When the second slide member is in a closed position relative to the first slide member, the pin member is located in a first path in the first passage of the guiding base.

When the second slide member applies a force relative to the first slide member, the pin member is guided by the first guide surface of the first wall and moves from the first path to the first slot. The pin member is located at a first position.

When the force is released, the pin member is guided by the guiding end of the separation body and moves from the first position to a second path in the second passage.

When the second slide member is retracted relative to the first slide member, the pin member is guided by the second guide surface of the second wall and moves from the second path to the second slot via the second passage. The pin member is located in a second position. When the second slide member is released, the pin member moves away from the second position and is engaged with the engaging surface of the engaging body and located in a third position.

When the second slide member further applies a force relative to the first slide member again, the pin member is guided by the third guide surface of the third wall and moves from the third position into the third slot. The pin member is located in a fourth position. When the second slide member is released, the pin member is guided by the fourth guide surface of the fourth wall.

When the second slide member moves relative to the first slide member, the link member pivots the positioning member by the movement of the second slide member.

The primary object of the present invention is to provide an auxiliary positioning device for a slide assembly to control the slide assembly to be positioned by operation of the auxiliary positioning device when the slide assembly is to be closed, such that the slide assembly is easily operated whenever it is closed or opened.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
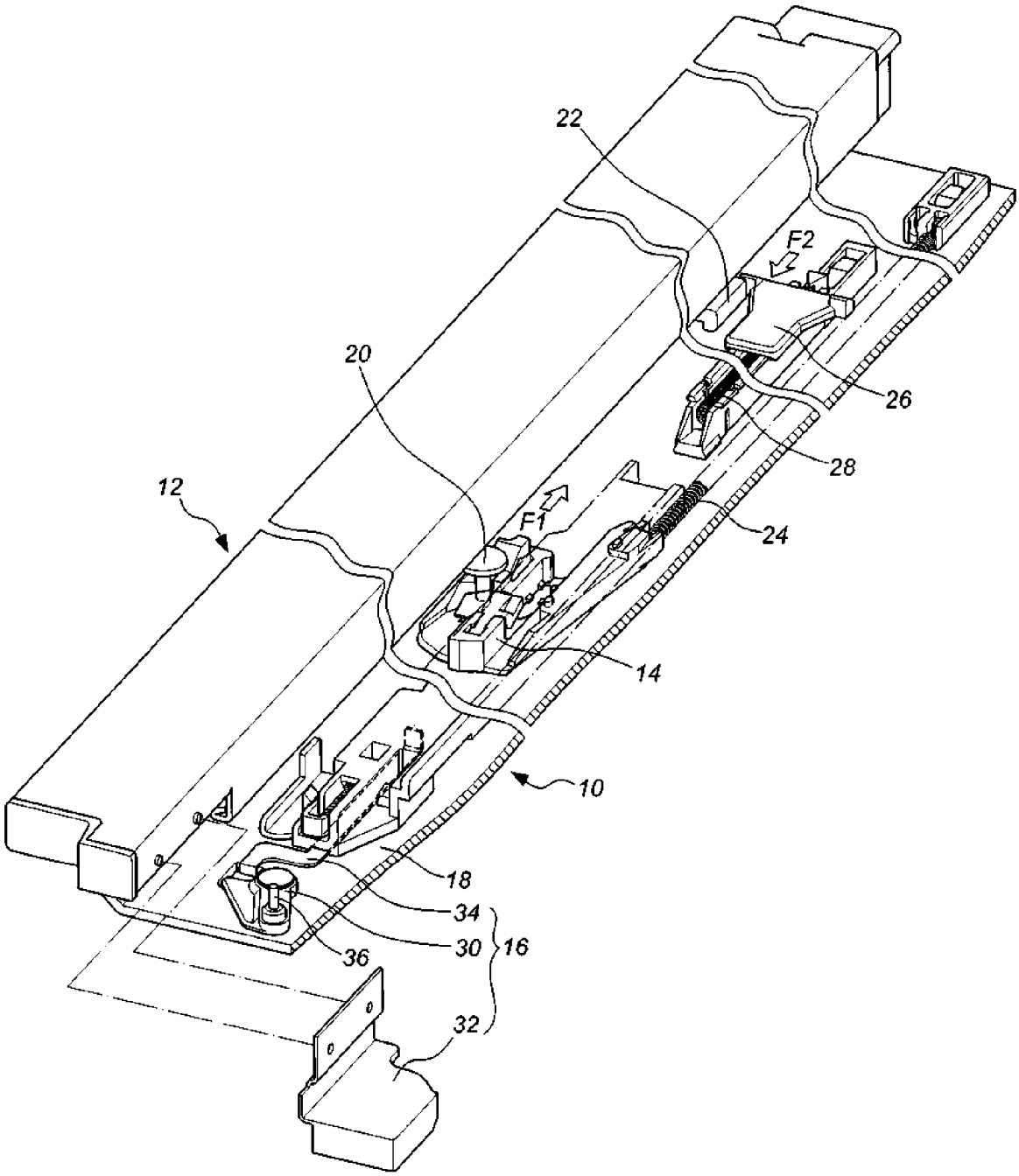
FIG. 1 shows the slide assembly according to a first embodiment of the present invention.
Figure 2:
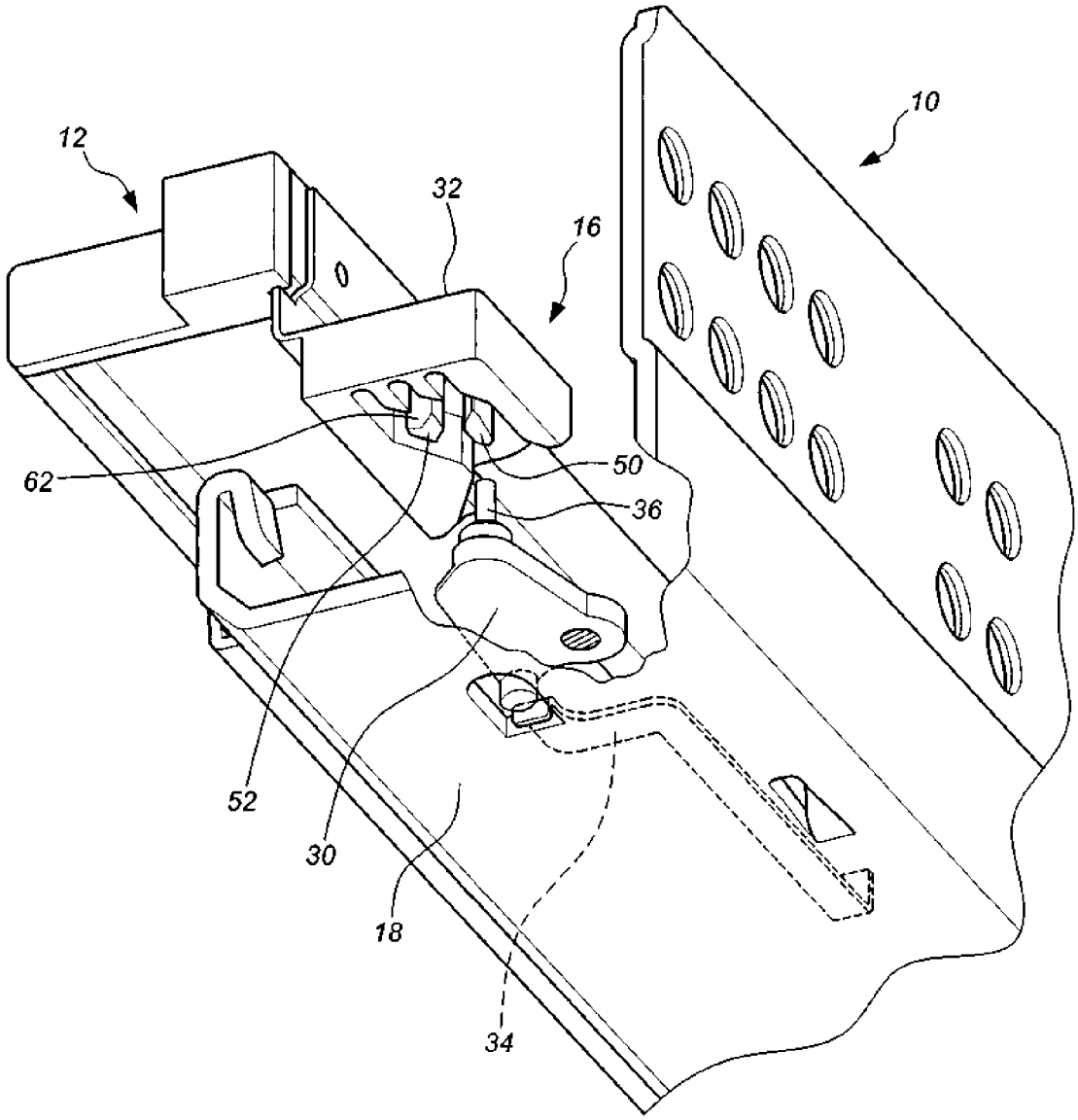
FIG. 2 shows a portion of the slide assembly according to the first embodiment of the present invention.

Referring to FIGS. 1 and 2, the slide assembly of the present invention comprises a first slide member 10, a second slide member 12 longitudinally and slidably movable relative to the first slide member 10, a movable member 14 connected to the first slide member 10 and an auxiliary positioning device 16.

The first slide member 10 includes a bottom board 18.

The second slide member 12 includes a first connector 20 and a second connector 22.

Figure 4:
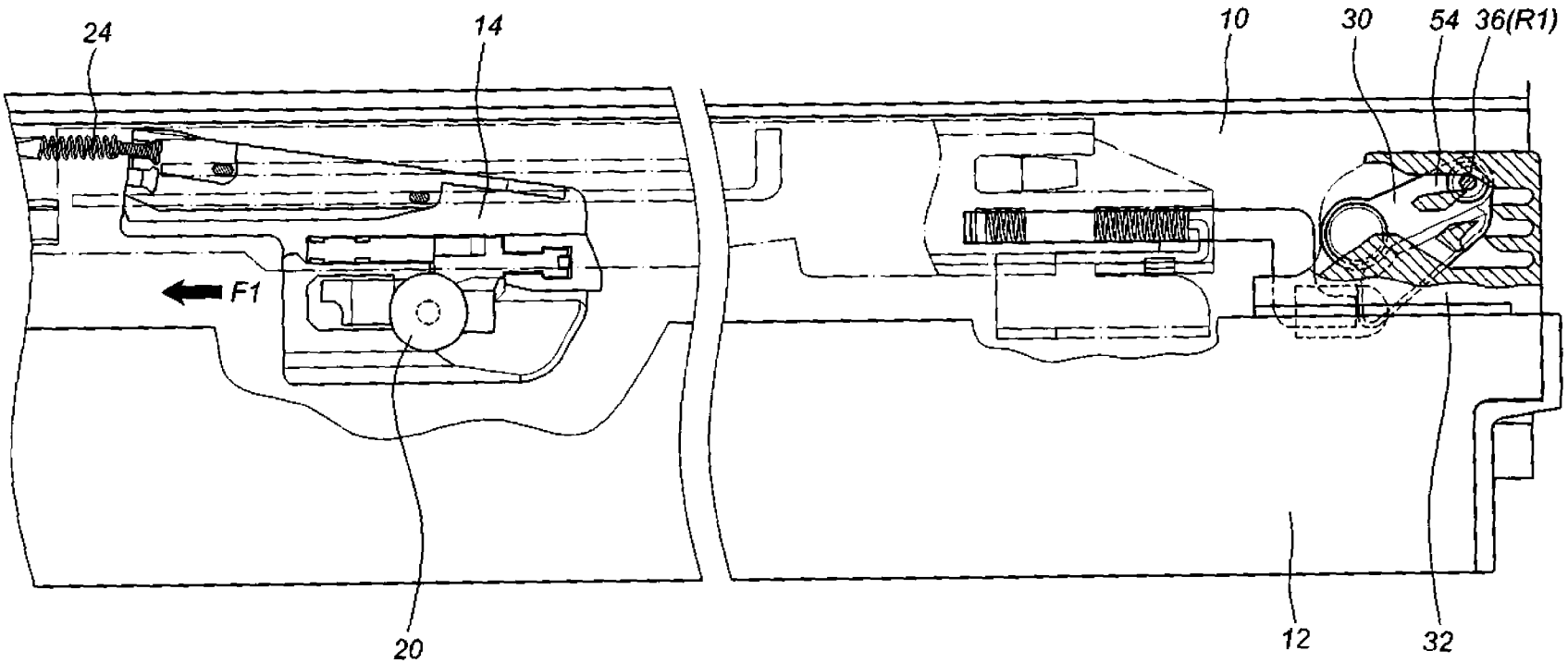
FIG. 4 shows that the positioning member is located in the first path relative to the guiding base when the second slide member is retracted relative to the first slide member according to the first embodiment of the present invention.
Figure 5:
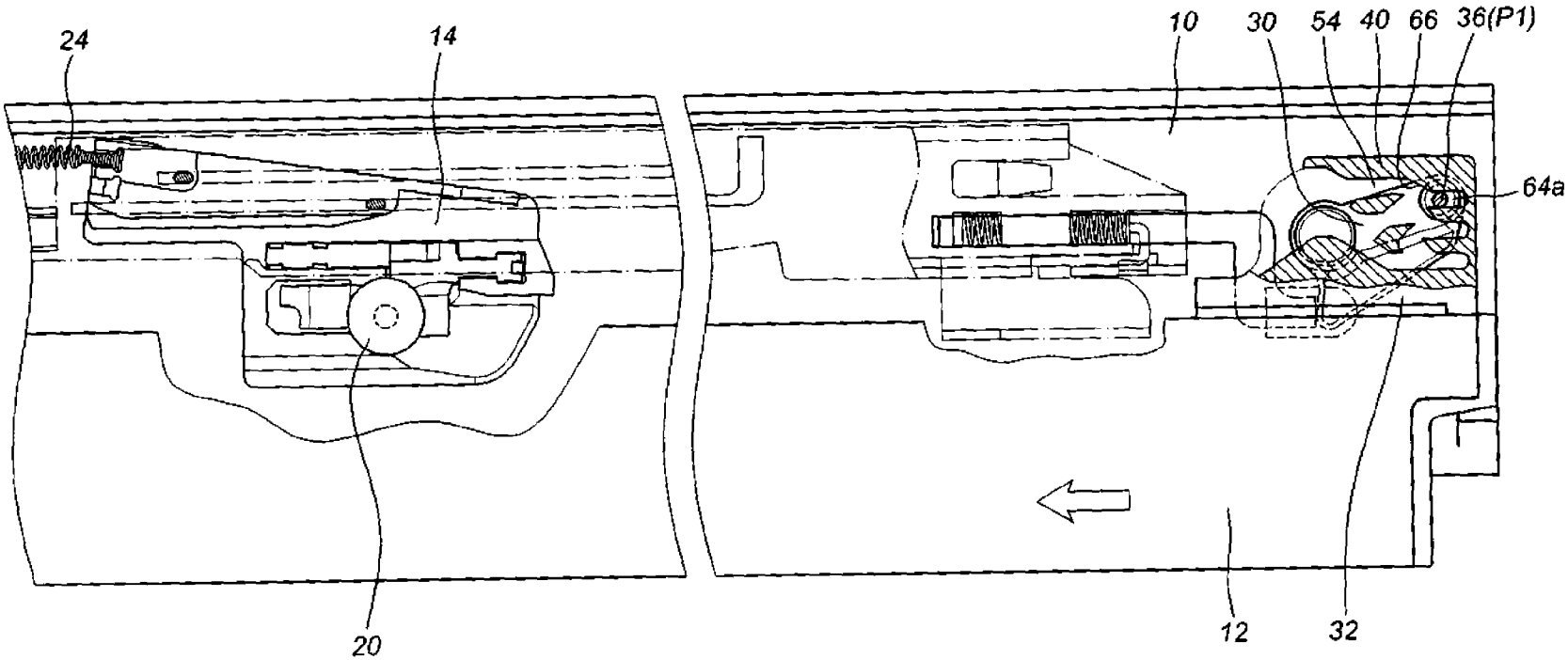
FIG. 5 shows that the second slide member applies a force relative to the first slide member and the positioning member is located at the first position relative to the guiding base according to the first embodiment of the present invention.
Figure 6:
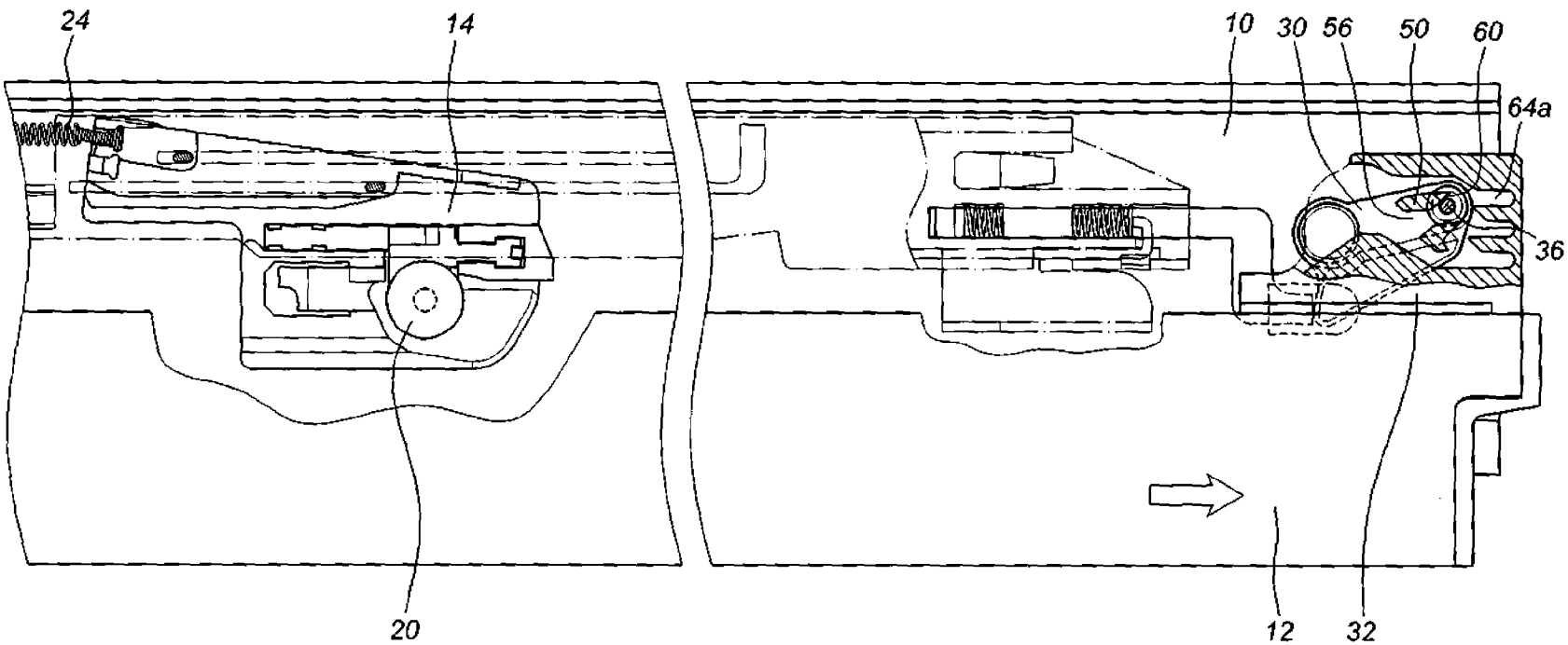
FIG. 6 shows that when the force is released, the positioning member is guided by the guiding base according to the first embodiment of the present invention.
Figure 7:
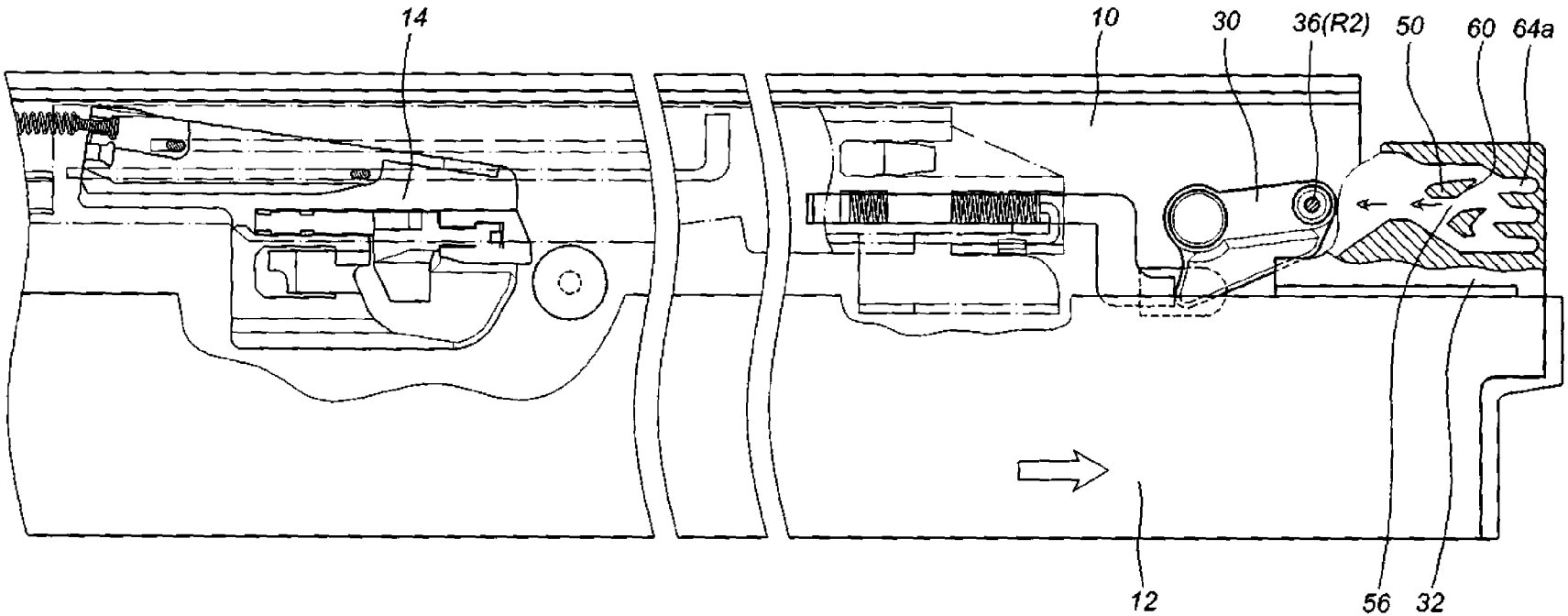
FIG. 7 shows that when the force is released, the positioning member is located in the second path relative to the guiding base according to the first embodiment of the present invention.

The movable member 14 is linked to move by the first connector 20 of the second slide member 12. For example, when the second slide member 12 is retracted relative to the first slide member 10 as shown in FIG. 4, the movable member 14 is connected to a first elastic member 24 and includes a first force F1 in a first direction and the first force F1 applies to the second slide member 12. The movable member 14 is engaged with the first connector 20, such that the second slide member 12 has a self-closing function relative to the first slide member 10 by the force of the first elastic member 24. When the second slide member 12 applies a force to the first slide member 10, as shown in FIG. 5, the second slide member 12 is pushed to a distance, the first connector 20 is disengaged from the movable member 14 as shown in FIGS. 6 and 7, and the force of the first elastic member 24 does not apply to the second slide member 12. In other words, the first force F1 that the movable member 14 applies to the second slide member 12 is released. As shown in FIG. 1, by a pushing member 26 to engage with the second connector 22 and a second elastic member 28 connected to the pushing member 26 for applying a second force F2 to the second slide member 12 in a second direction, the second slide member 12 has a self-opening function relative to the first slide member 10. When the second slide member 12 is in a retracted status relative to the first slide member 10, the second slide member 12 will store a force to pop out the second slide member 12. The dual functions, self-closing and self-opening functions, have been disclosed in the applicant's former U.S. patent application Ser. No. 12/505,791 which is a reference when studying the present invention.

The auxiliary positioning device 16 comprises a positioning member 30 which is pivotably connected to the first slide member 10, a guiding base 32 attached to the second slide member 12, and a link member 34 movably connected to the first slide member 10.

The positioning member 30 includes a pin member 36 and a contact end 38 which is located at a different position from that of the pin member 36. The positioning member 30 is linked to move by the link member 34 to keep the pin member 36 at a specific position.

Figure 3:
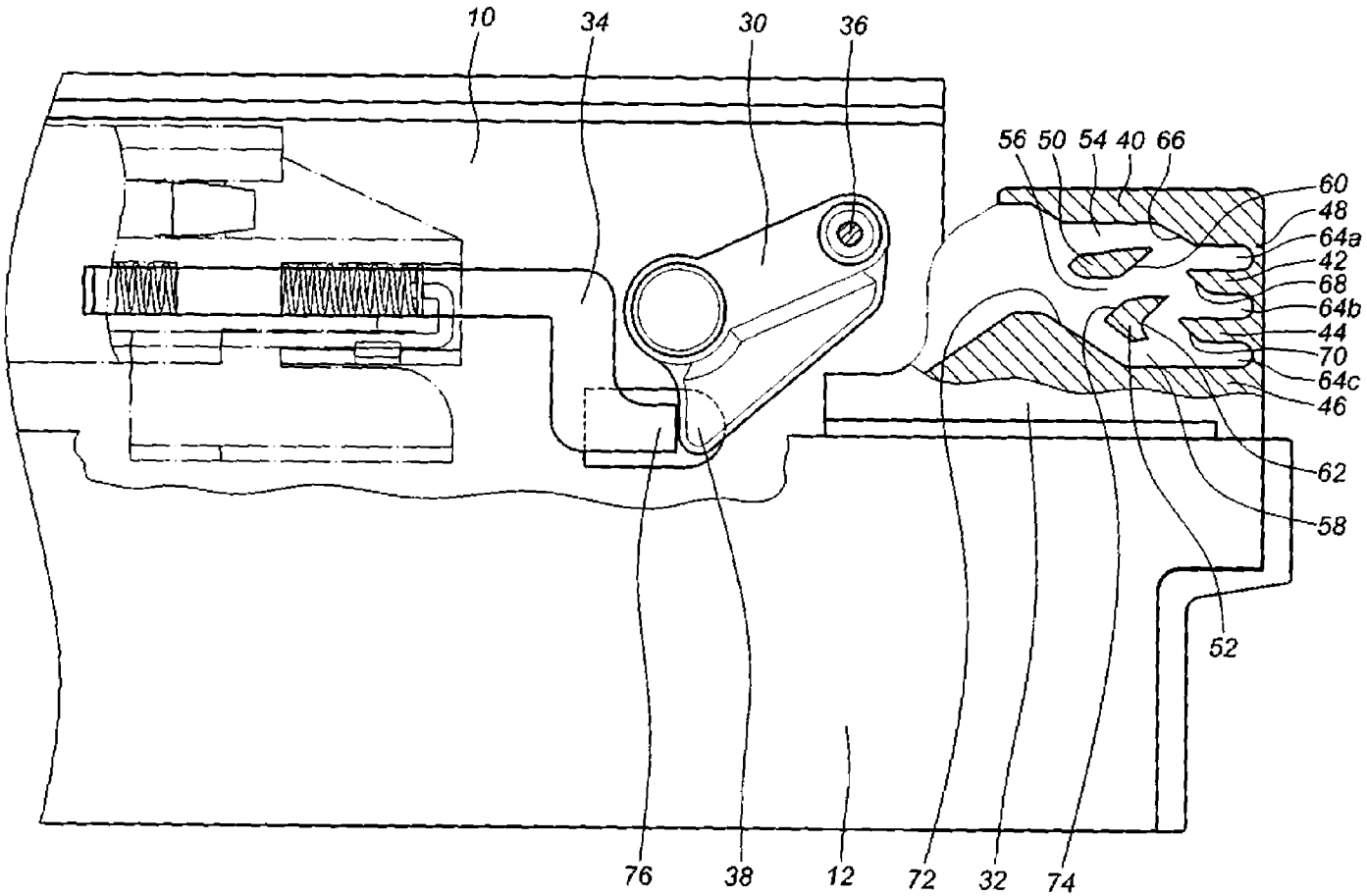
FIG. 3 shows the auxiliary positioning device according to the first embodiment of the present invention.

Referring to FIGS. 2 and 3, the guiding base 32 comprises a first wall 40, a second wall 42, a third wall 44, a fourth wall 46, a connection wall 48, a separation body 50 and an engaging body 52. The connection wall 48 is connected to the first, second, third and fourth walls 40, 42, 44, 46. The first wall 40 and the separation body 50 define a first passage 54. The separation body 50 and the engaging body 52 define a second passage 56. The engaging body 52 and the fourth wall 46 define a third passage 58. The separation body 50 has a guiding end 60. The engaging body 52 includes an engaging surface 62 which is a recessed area. The first, second and connection walls 40, 42, 48 define a first slot 64*a*. The second, third and connection walls 42, 44, 48 define a second slot 64*b*. The third, fourth and the connection walls 44, 46, 48 define a third slot 64*c*. The third slot 64*c* faces the third passage 58. The first wall 40 has a first guide surface 66 in the longitudinal direction facing a portion of the first passage 54 so as to guide the first passage 54 to face the first slot 64*a*. The second wall 42 has a second guide surface 68 in the longitudinal direction facing a portion of the second passage 56 so as to guide the second passage 56 to face the second slot 64*b*. The third wall 44 has a third guide surface 70 in the longitudinal direction facing a portion of the engaging surface 62 of the engaging body 52. The fourth wall 46 includes a fourth guide surface 72 so as to guide the pin member 36 of the positioning member 30 to face the second passage 56. A portion of the guiding end 60 of the separation body 50 faces a portion of the first slot 64*a* in the longitudinal direction so as to guide the first slot 64*a* to face the second passage 56. The rest portion of the engaging surface 62 of the engaging body 52 faces the second slot 64*b* in the longitudinal direction. In this embodiment, the engaging body 52 further includes a fifth guide surface 74 which faces the second passage 56.

The link member 34 is moved by the movable member 14. The link member 34 has an operation end 76 to lean against the contact end 38 of the positioning member 30. As shown in FIGS. 1 and 3, the positioning member 30 is pivoted by the link member 34 and rotated an angle relative to the first slide member 10.

Referring to FIG. 4, the second slide member 12 is in a retraced position relative to the first slide member 10. The pin member 36 of the positioning member 30 is located in a first path R1 relative to the first passage 54 of the guiding base 32 and the first force F1 of the movable member 14 applies to the second slide member 12 so that the second slide member 12 is maintained in the retracted position relative to the first slide member 10.

Referring to FIG. 5, the second slide member 12 applies a force to the first slide member 10, the guiding base 32 moves relative to the positioning member 30 and the pin member 36 of the positioning member 30 is guided by the first guide surface 66 of the first wall 40 of the guiding base 32 from the first path R1 in the first passage 54 to the first slot 64*a* of the guiding base 32, and the pin member 36 is located at a first position P1.

When the force that the second slide member 12 applies to the first slide member 10 is released, the first connector 20 of the second slide member 12 is disengaged from the movable member 14 so that the first force F1 from the first elastic member 24 no longer applies to the second slide member 12. The pushing member 26 and the second elastic member 28 apply the second force F2 to the second connector 22 of the second slide member 12 (referring to FIG. 1 and the disclosure in U.S. patent application Ser. No. 12/505,791). The second slide member 12 is automatically opened relative to the first slide member 10. As shown in FIGS. 6 and 7, the guiding base 32 is moved together with the second slide member 12 relative to the positioning member 30, the pin member 36 of the positioning member 30 is guided by the guiding end 60 of the separation body 50 and moves from the first position P1 in the first slot 64*a* to a second path R2 via the second passage 56 of the guiding base 32. In this status, the second slide member 12 freely pops out and can be pulled out relative to the first slide member 10.

When the force applied to the first slide member 10 by the second slide member 12 is released, the second slide member 12 only pops out a small distance relative to the first slide member 10. If the second slide member 12 is not pulled out and moves the movable member 14, the second slide member 12 is pushed inward relative to the first slide member 10, as shown in FIG. 8, the guiding base 32 is moved relative to the positioning member 30, and the pin member 36 of the positioning member 30 is moved from the second path R2 to the second slot 64*b* and located at a second position P2 by the guidance of the second guide surface 68 of the second wall 42 and via the second passage 56.

Figure 8:
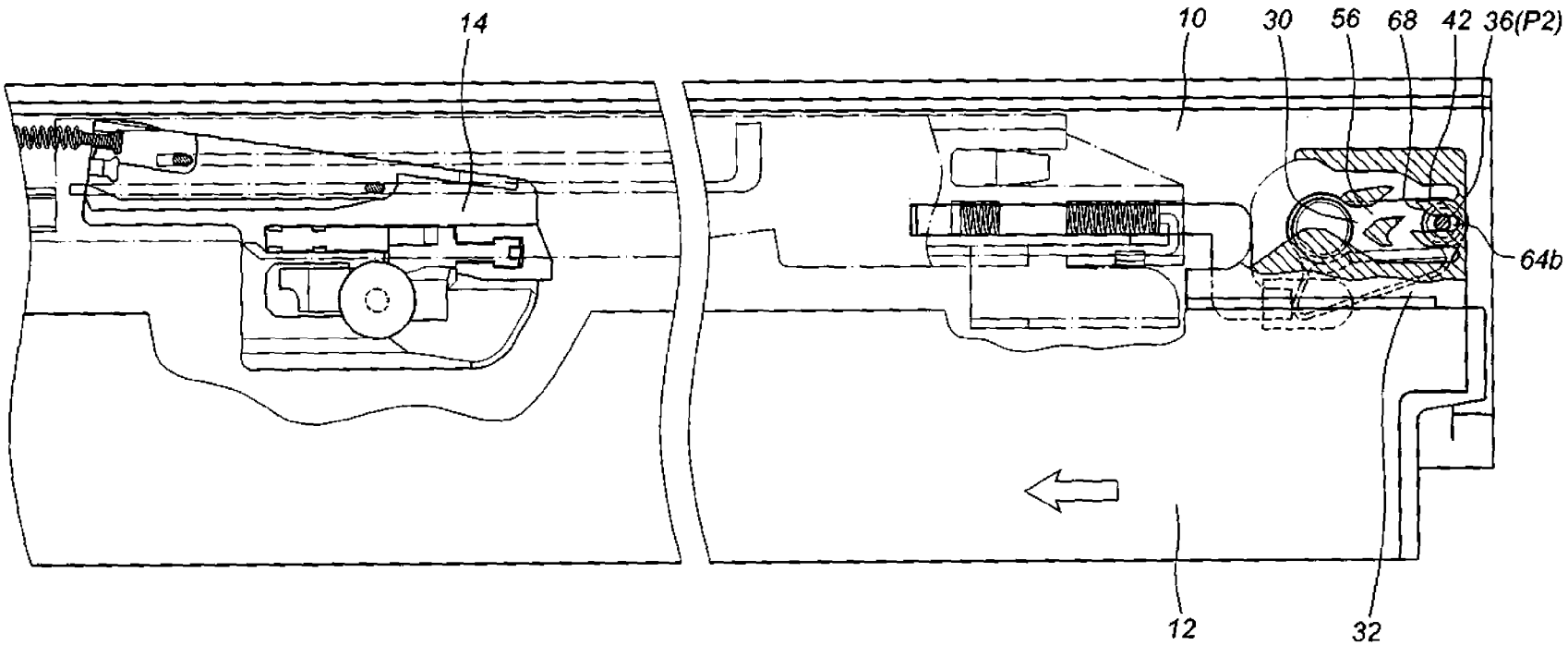
FIG. 8 shows that when the second slide member is retracted relative to the first slide member, the positioning member is located in the second position relative to the guiding base according to the first embodiment of the present invention.
Figure 9:
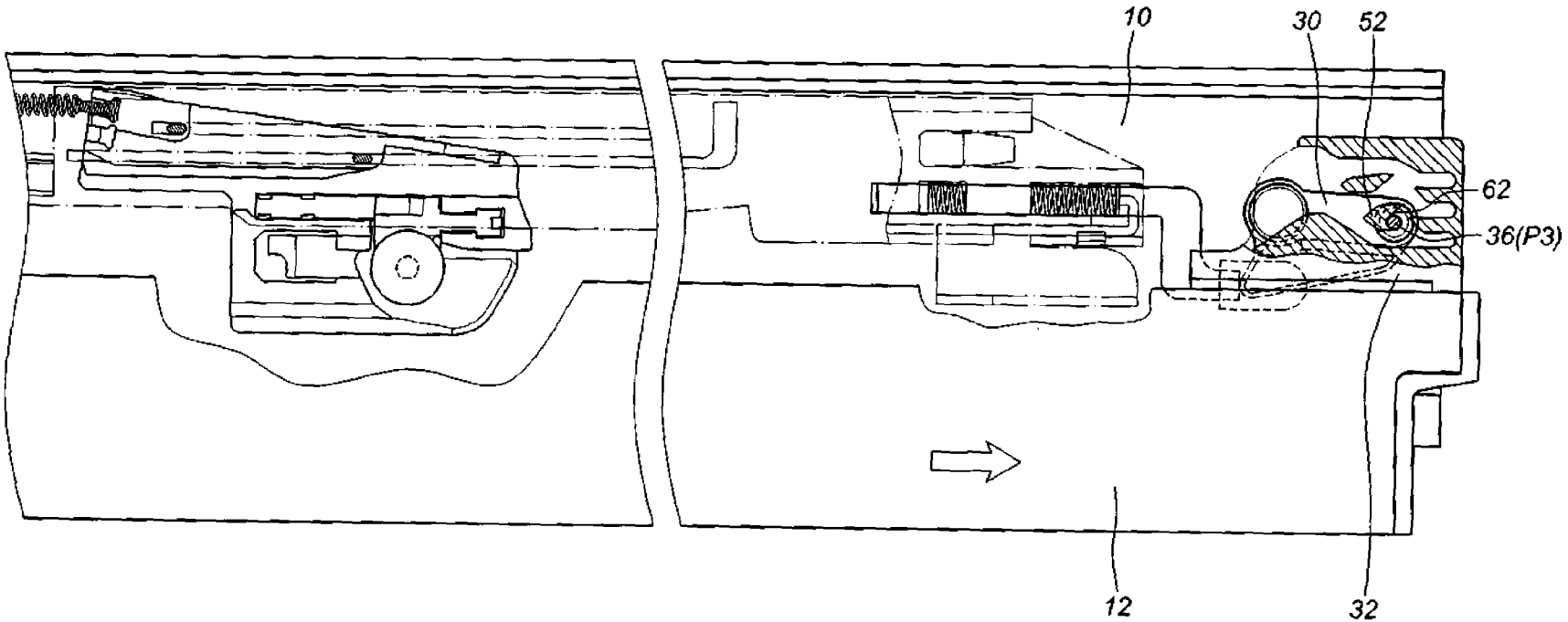
FIG. 9 shows that when the second slide member is released, the positioning member is located at the third position relative to the guiding base according to the first embodiment of the present invention.

FIG. 9 shows the action following the status in FIG. 8. When the force applied to the second slide member 12 is released, the second slide member 12 will drive the guiding base 32 relative to the first slide member 10 to move from the positioning member 30 by the second force F2. The pin member 36 of the positioning member 30 moves away from the second position P2 and is engaged with the engaging surface 62 of the engaging body 52 so as to be positioned at a third positioning P3.

When the second slide member 12 is popped out relative to the first slide member 10 and the second slide member 12 is not pulled relative to the first slide member 10 to a distance for moving the movable member 14 to a position that stores a force to return the second slide member 12 automatically, by changing the path between the pin member 36 in the first passage 54 and the second passage 56 as well as the pin member 36 to engage with the engaging surface 62 of the engaging body 52, the second slide member 12 can be pushed inward relative to the first slide member 10 and maintained at the retracted position. Accordingly, the second slide member 12 has no need to be pulled out for a longer distance relative to the first slide member 10.

Figure 10:
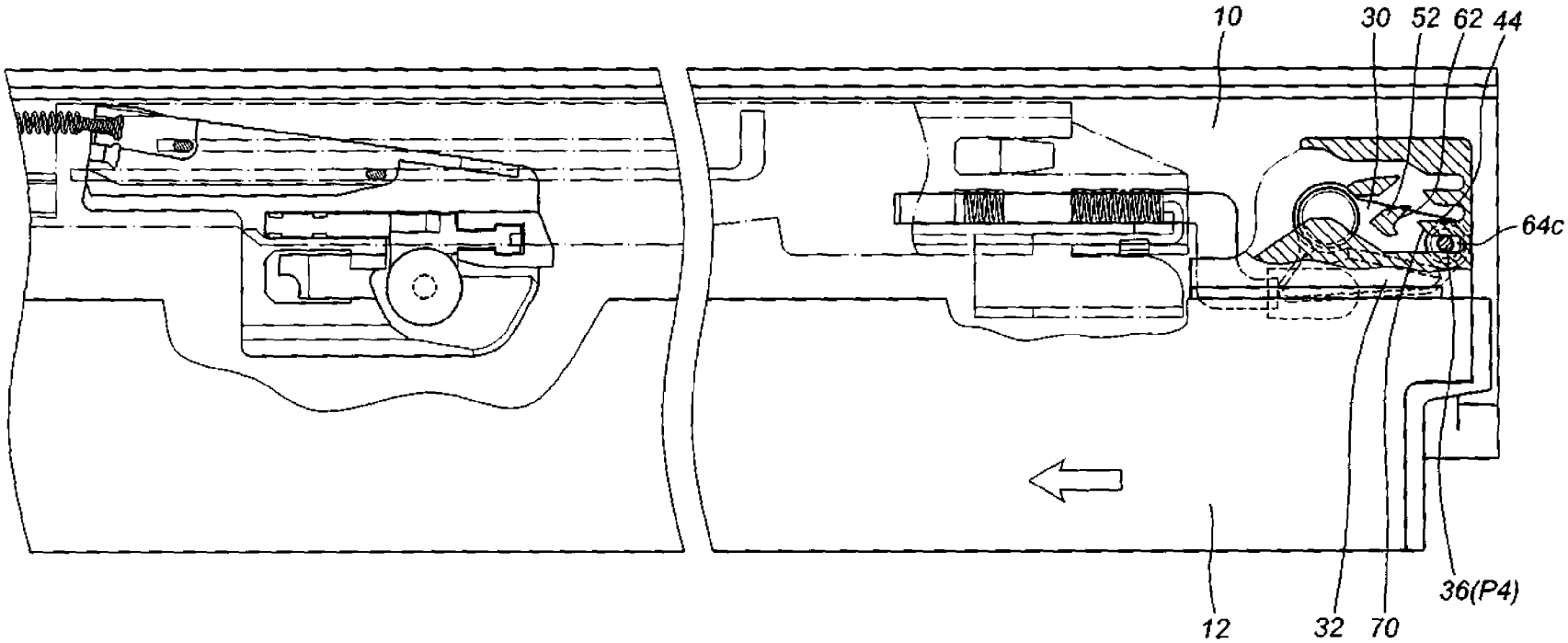
FIG. 10 shows that when the second slide member is further pressed relative to the first slide member, the positioning member is located at the fourth position relative to the guiding base according to the first embodiment of the present invention.
Figure 11:
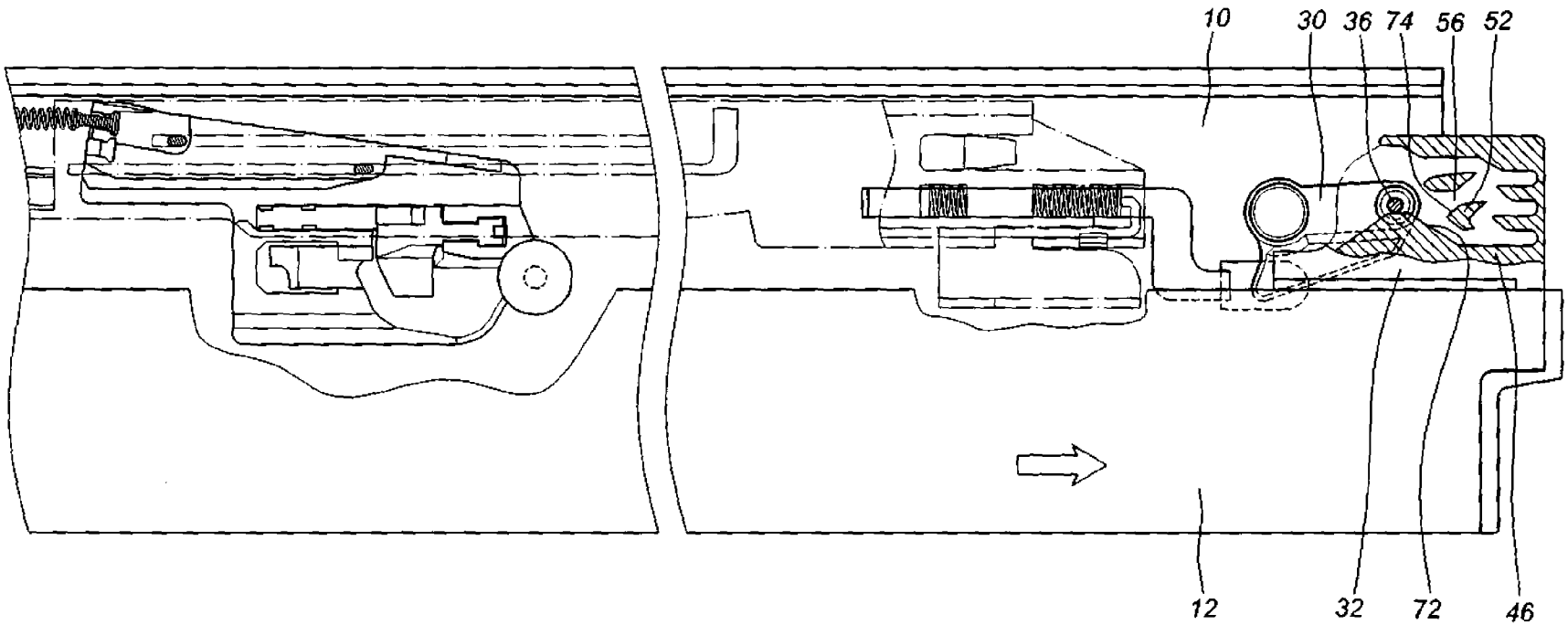
FIG. 11 shows that the positioning member is guided by the fourth guide surface of the guiding base according to the first embodiment of the present invention.

When the second slide member 12 applies a push force relative to the first slide member 10 again, as shown in FIG. 10, the guiding base 32 moves relative to the positioning member 30 and the pin member 36 is guided by the third guide surface 70 of the third wall 44 from the engaging surface 62 of the engaging body 52 to the third slot 64*c* of the guiding base 32. The pin member 36 is then located at a fourth position P4. In this status, when the second slide member 12 is released again, the second slide member 12 freely pops out or is pulled out to a further distance relative to the first slide member 10, as shown in FIG. 11. The pin member 36 moves along the fourth guide surface 72 of the fourth wall 46 of the guiding base 32. When the second slide member 12 is further pushed inward relative to the first slide member 10 again, the pin member 36 is guided by the fifth guide surface 74 of the engaging body 52 and enters the second passage 56.

Figure 12:
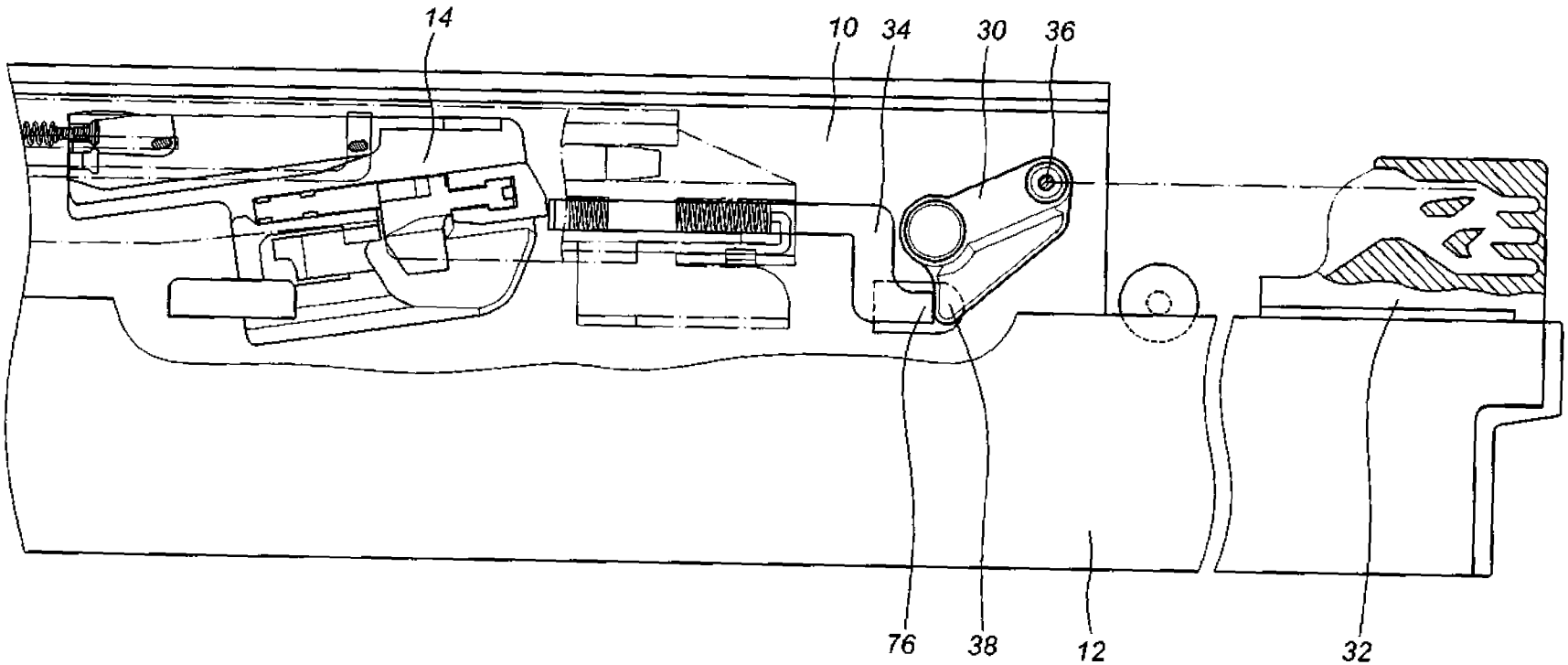
FIG. 12 shows that when the second slide member is pulled relative to the first slide member, the link member is moved to push the positioning member according to the first embodiment of the present invention.

FIG. 12 shows that when the second slide member 12 is pulled out relative to the first slide member 10 and the movable member 14 is moved to a position that stores sufficient return force to bring the second slide member 12, the link member 34 is moved by the movement of the movable member 14. The operation end 76 of the link member 34 leans against the contact end 38 of the positioning member 30 to pivot the positioning member 30 to move the pin member 36 back to the first passage 54, which corresponds to the first path R1. Accordingly, when the second slide member 12 is retracted relative to the first slide member 10, the second slide member 12 is back to the status as shown in FIG. 4.

Figure 13:
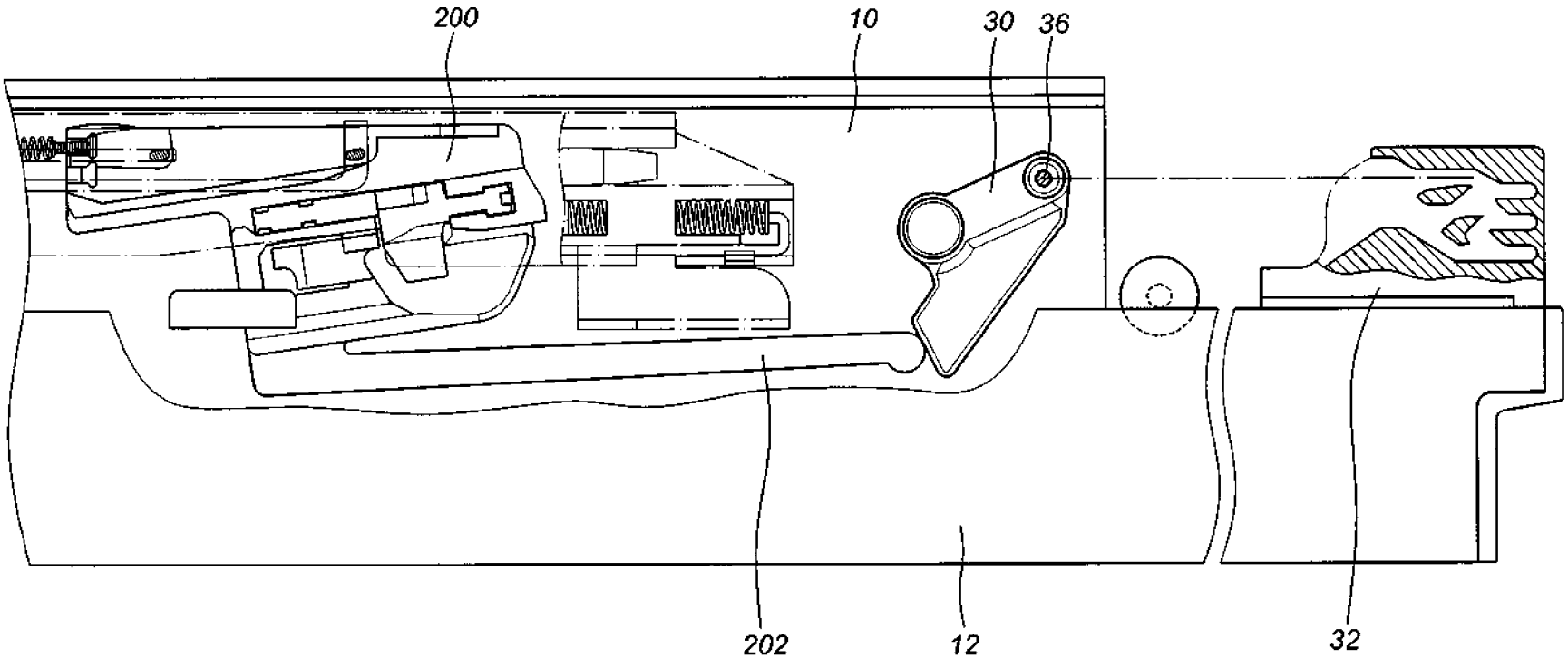
FIG. 13 is a schematic view showing the link member leaning against the positioning member according to a second embodiment of the present invention.

FIG. 13 shows a second embodiment of the present invention, wherein the movable member 200 includes a link member 202 which extends to the positioning member 30. When the second slide member 12 is pulled out, relative to the first slide member 10, to the position that can be automatically retracted as mentioned above, the positioning member 30 is pivoted by the link member 202 and the pin member 36 of the positioning member 30 is located in the first path R1.

Figure 14:
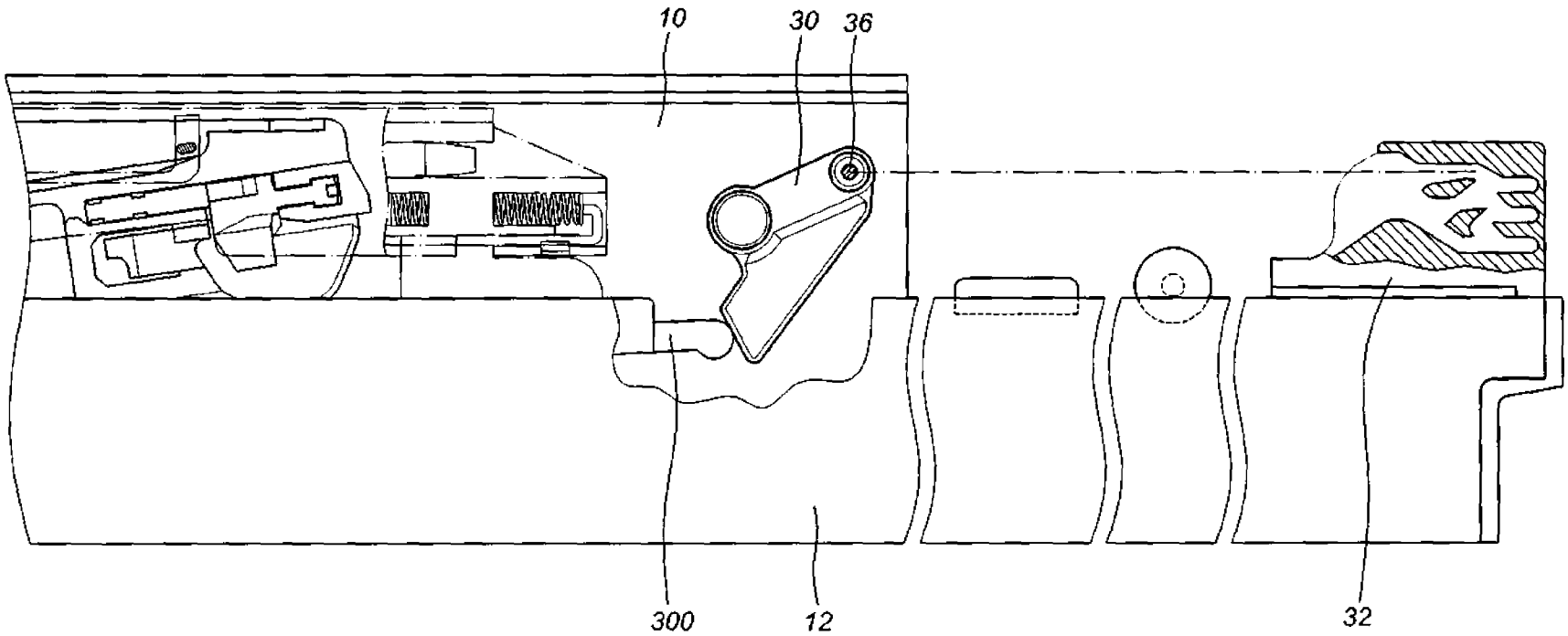
FIG. 14 is a schematic view showing the link member leaning against the positioning member according to a third embodiment of the present invention.

FIG. 14 shows a third embodiment of the present invention, wherein a link member 300 is fixed to the second slide member 12 and located corresponding to the positioning member 30. When the second slide member 12 is pulled out, relative to the first slide member 10, to the position that can be automatically retracted as mentioned above, the positioning member 30 is pivoted by the link member 300 and the pin member 36 of the positioning member 30 is located in the first path R1.

Figure 15:
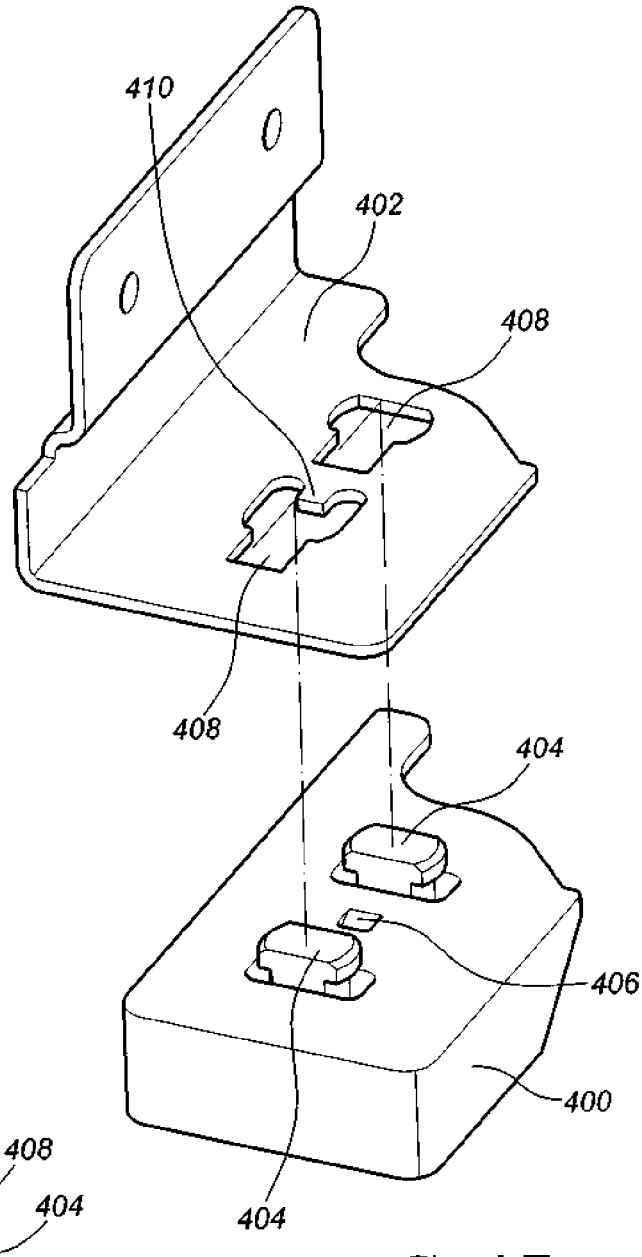
FIG. 15 is an exploded view of the guiding base according to a fourth embodiment of the present invention.
Figure 16:
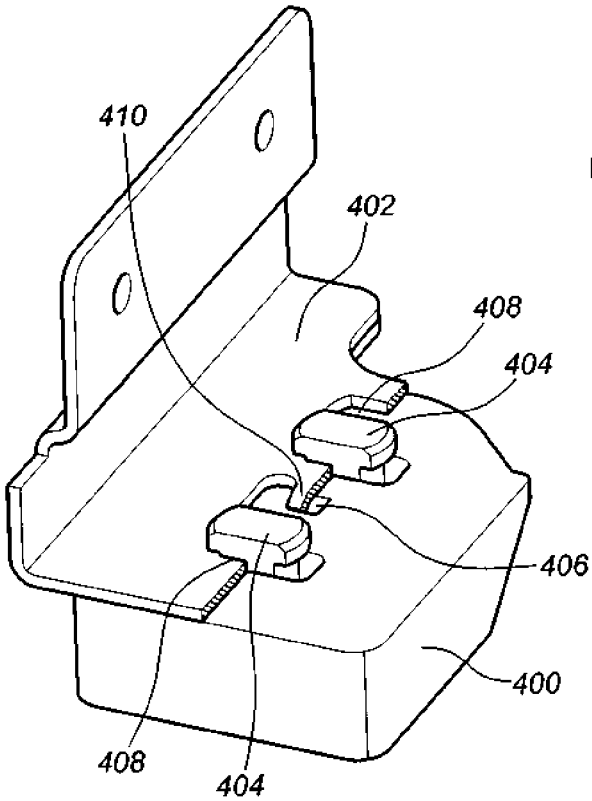
FIG. 16 is a perspective view of the guiding base according to the fourth embodiment of the present invention.

FIG. 15 shows a fourth embodiment of the present invention, which includes a guiding base 400 and a connection board 402. The guiding base 400 includes a pair of engaging portions 404 and an engaging hole 406. The connection board 402 includes a pair of engaging slots 408 and an engaging member 410 corresponding to the engaging hole 406 so as to position the guiding base 400, as shown in FIG. 16. In this embodiment, the connection board 402 is connected to the second slide member 12 such that the guiding base 400 is connected to the second slide member 12.

Figure 17:
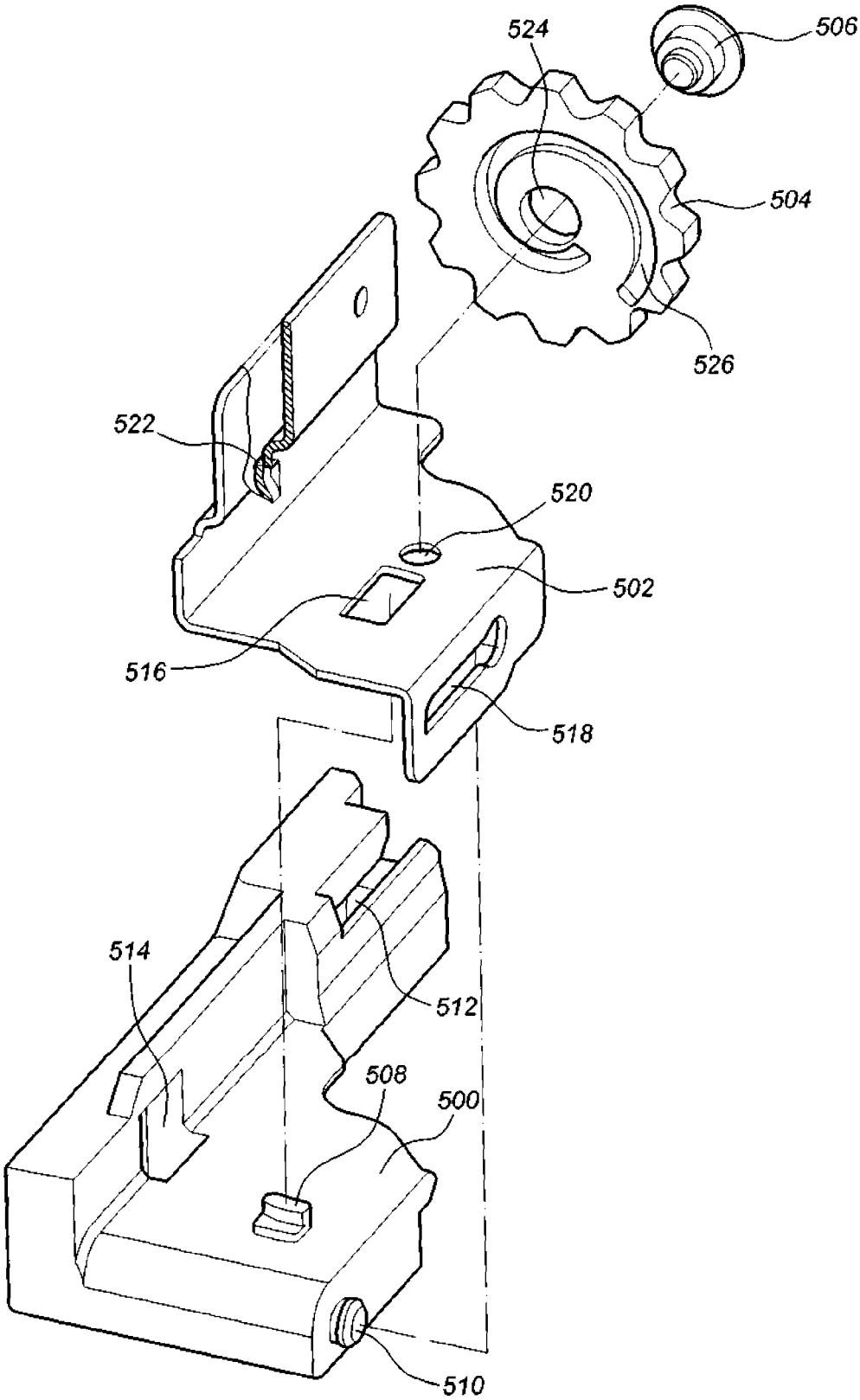
FIG. 17 is an exploded view of the guiding base according to a fifth embodiment of the present invention.
Figure 18:
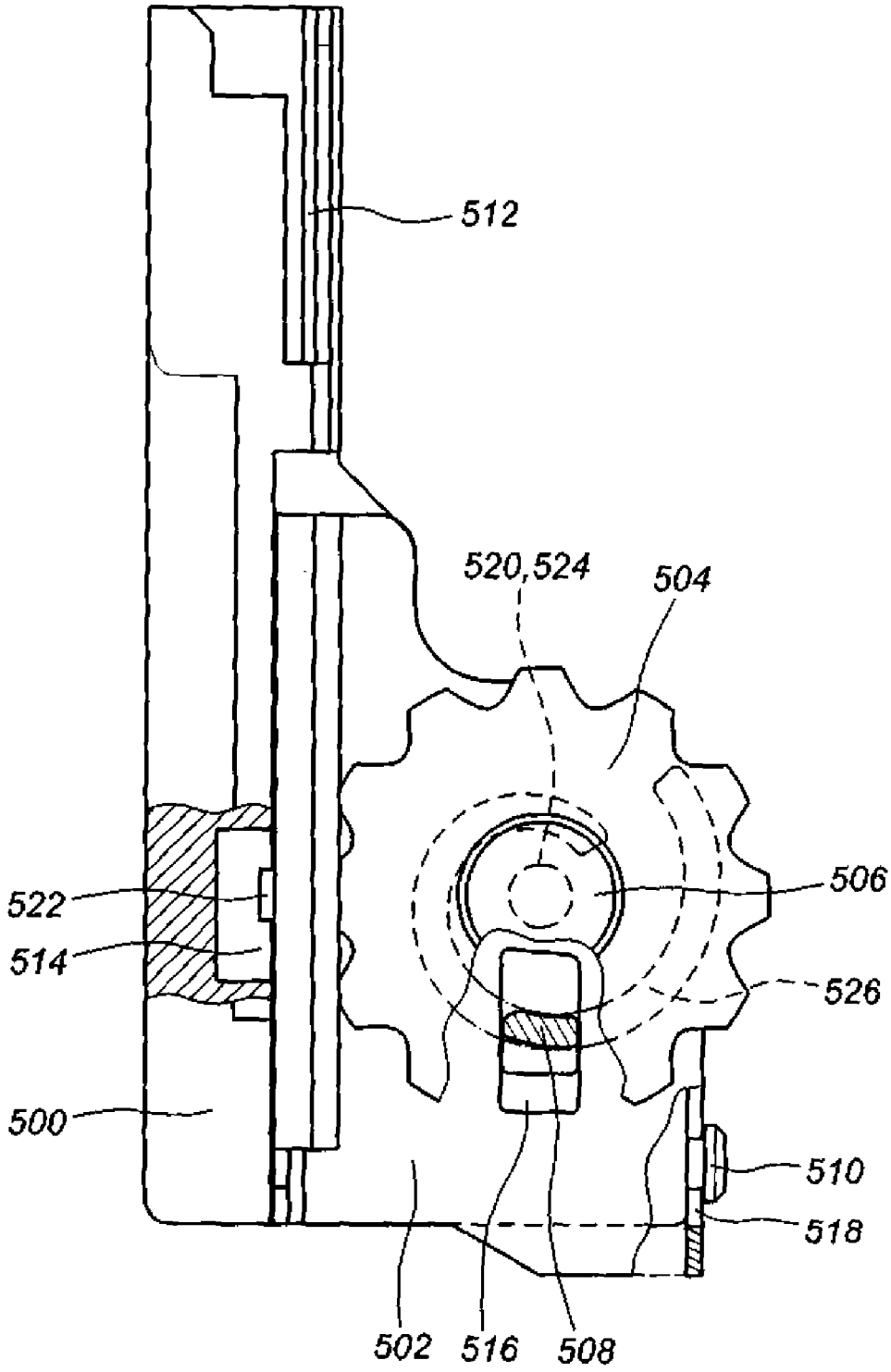
FIG. 18 is an assembled view of the guiding base according to the fifth embodiment of the present invention.

FIGS. 17 and 18 show a fifth embodiment of the present invention, which includes a guiding base 500, a connection board 502, an adjusting member 504 and a pivot member 506. The guiding base 500 includes a protrusion 508, a connection member 510, a longitudinal groove 512, and a recess 514. The connection board 502 includes a first longitudinal slot 516, a second longitudinal slot 518, a fixing hole 520 and a protruding portion 522. The protrusion 508 extends beyond the first longitudinal slot 516. The connection member 510 is inserted in the second longitudinal slot 518. The protruding portion 522 is engaged with a portion of the recess 514 so that the guiding base 500 is movably connected to the connection board 502 and moves longitudinally. The adjusting member 504 includes an aperture 524 and a spiral recess 526. The pivot member 506 extends through the aperture 524 of the adjusting member 504 and is connected with the fixing hole 520 of the connection board 502, such that the adjusting member 504 is rotatable relative to the connection board 502.

Figure 19:
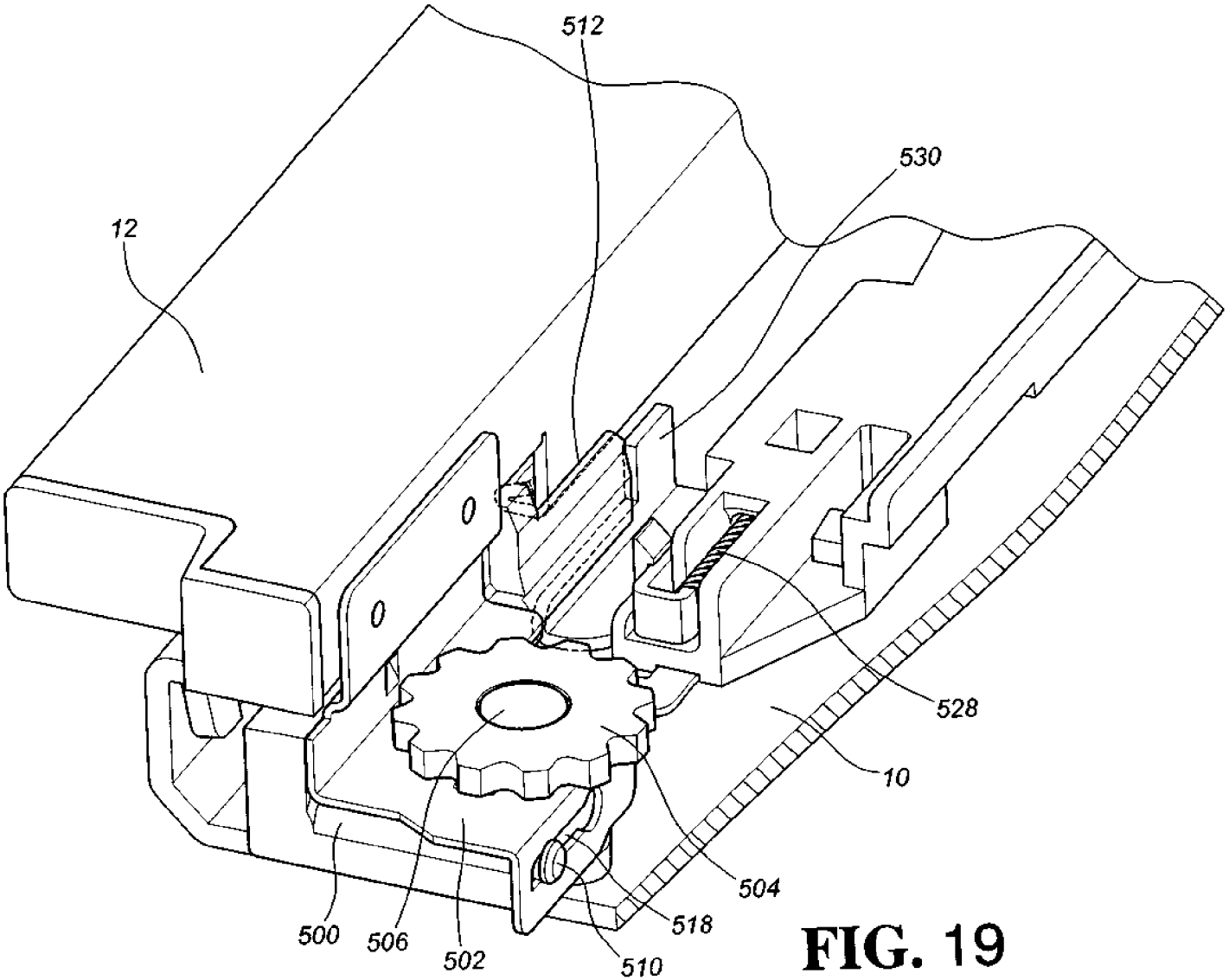
FIG. 19 is a schematic view showing a portion of the slide assembly according to the fifth embodiment of the present invention.
Figure 20:
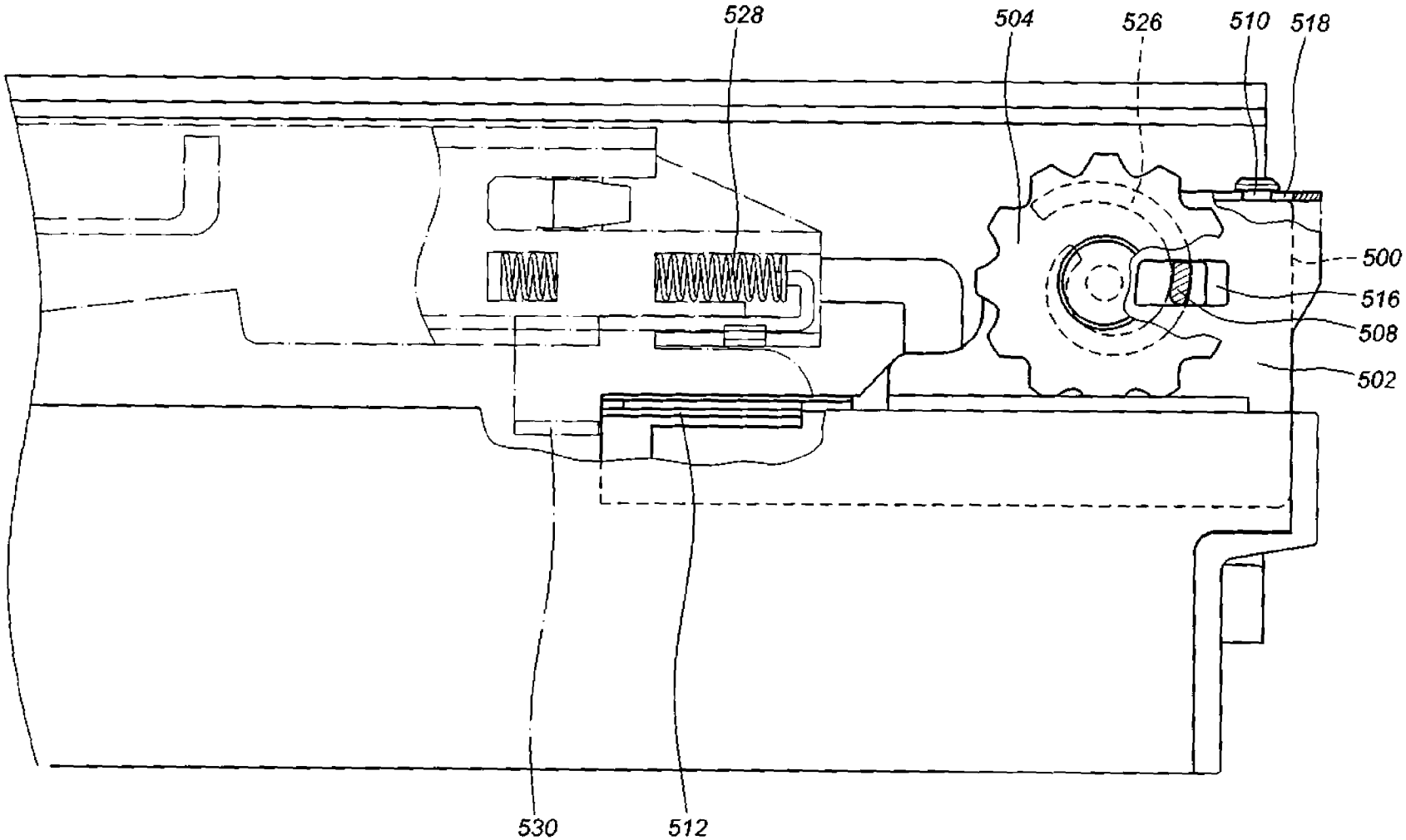
FIG. 20 is an assembled view showing the guiding base and the adjusting member according to the fifth embodiment of the present invention.

FIGS. 19 and 20 show the assembled configuration of the fifth embodiment. A portion of the second slide member 12 is connected with the longitudinal groove 512 of the guiding base 500. The connection board 502 is fixed to the second slide member 12. The protrusion 508 of the guiding base 500 is movable in the spiral recess 526. When the adjusting member 504 is rotated by the user, the protrusion 508 of the guiding base 500 will be moved in the spiral recess 526 and the guiding base 500 will be moved longitudinally relative to the connection board 502. Therefore, when the guiding base 500 is adjusted to move longitudinally relative to the second slide member 12 by operation of the adjusting member 504, a relative position between the guiding base 500 and the positioning member 30 is adjusted. Besides, this embodiment further includes a third elastic member 528 and a stop 530 which is urged by the third elastic member 528 to be contact with an end outside of the longitudinal groove 512 of the guiding base 500, such that the depth in the longitudinal direction of the second slide member 12 relative to the first slide member 10 can also be adjusted. This allows the assemblers to micro-adjust the depth of the drawer in the furniture.

Figure 21:
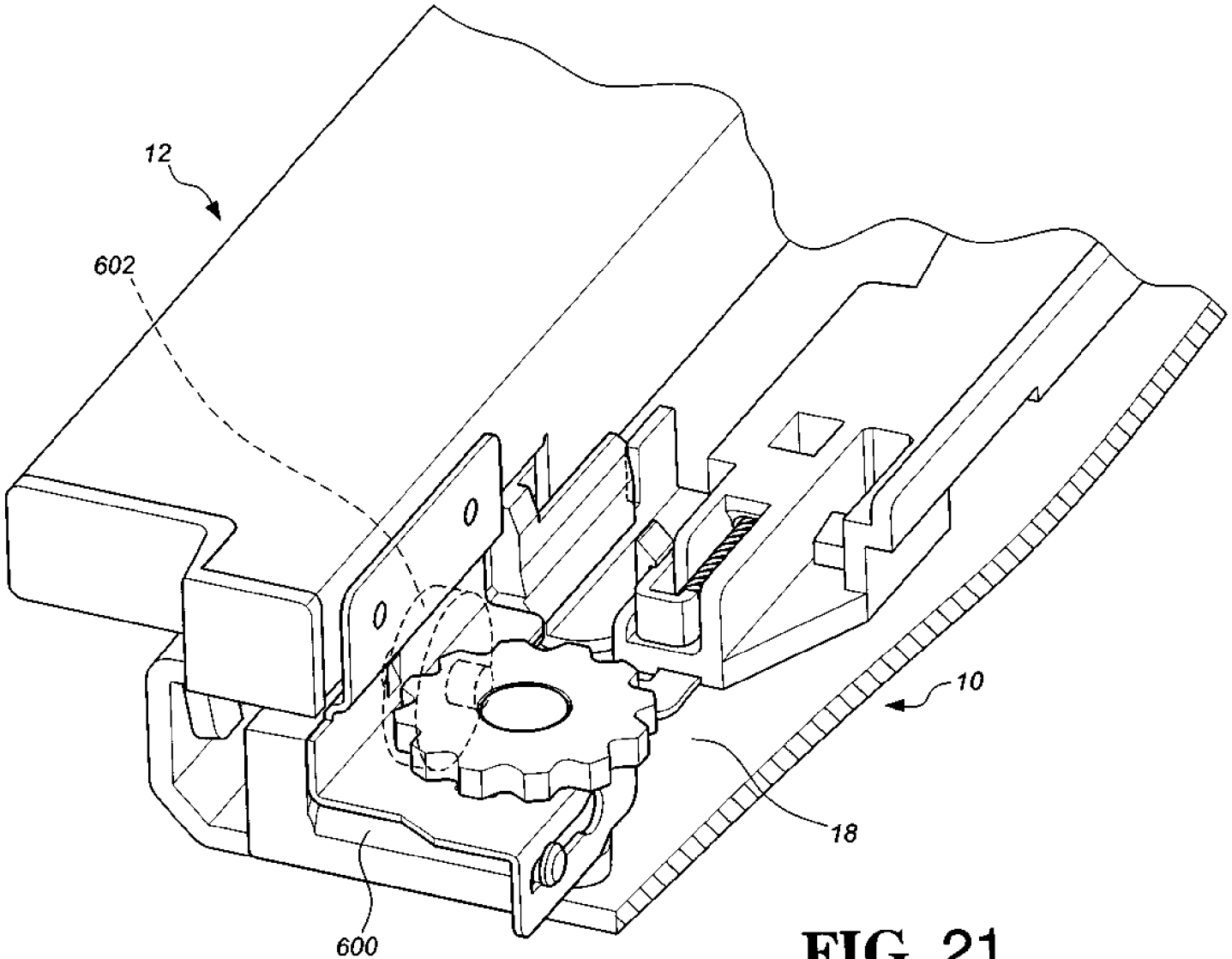
FIG. 21 is a schematic view showing a portion of the slide assembly according to a sixth embodiment of the present invention.

FIG. 21 shows a sixth embodiment of the present invention, wherein a roller 602 is connected to a guiding base 600 and the roller 620 has a rolling surface facing the bottom board 18 of the first slide member 10. When the load in the drawer applies to the second slide member 12, the second slide member 12 slightly moves downward relative to the first slide member 10, the rolling surface of the roller 602 is supported between the guiding base 600 and the bottom board 18 of the first slide member 10 so as to ensure that the guiding base 600 is maintained at a position relative to the positioning member 30.

While we have shown and described the embodiment in accordance with the present invention, it should be clear to those skilled in the art that further embodiments may be made without departing from the scope of the present invention.

What is claimed is:

1. A slide assembly with an auxiliary positioning device, comprising:

a first slide member;

a second slide member longitudinally and slidably movable relative to the first slide member, the second slide member having a stored opening force relative to the first slide member when in a closed position;

the auxiliary positioning device comprising:

a positioning member pivotably connected to the first slide member, the positioning member including a pin member;

a guiding base attached to the second slide member, the guiding base comprising a first passage, a first slot and a first wall, the first wall having a first guide surface facing the first passage; a second passage, a second slot and a second wall, the second wall having a second guide surface facing the second passage; a separation body having a guiding end which faces the first slot; an engaging body having an engaging surface which has a portion facing the second slot; a third passage, a third slot and a third wall, the third wall having a third guide surface facing the rest portion of the engaging surface; a fourth wall having a fourth guide surface; and a link member located corresponding to the positioning member;

wherein the pin member is located in a first path in the first passage of the guiding base when the second slide member is in the closed position relative to the first slide member;

wherein the pin member is guided by the first guide surface of the first wall and moves from the first path to the first slot and the pin member is located at a first position when the second slide member applies a force relative to the first slide member;

wherein the pin member is guided by the guiding end of the separation body and moves from the first position to a second path in the second passage when the force is released;

wherein the pin member is guided by the second guide surface of the second wall and moves away from the second path to the second slot via the second passage and the pin member is located in a second position when the second slide member is retracted relative to the first slide member; the pin member moves away from the second position to engage with the engaging surface of the engaging body and located in a third position when the second slide member is released;

wherein the pin member is guided by the third guide surface of the third wall and moves from the third position into the third slot and the pin member is located in a fourth position when the second slide member further applies a force relative to the first slide member; the pin member is guided by the fourth guide surface of the fourth wall when the second slide member is released;

wherein the link member pivots the positioning member by the movement of the second slide member when the second slide member moves relative to the first slide member.

2. The slide assembly as claimed in claim 1, wherein the first passage is defined by the first wall and the separation body; the second passage is defined by the separation body and the engaging body; the third passage is defined by the engaging body and the fourth wall; the first slot is defined by the first and second walls, the second slot is defined by the second and third walls; the third slot is defined by the third and fourth walls.

3. The slide assembly as claimed in claim 1, wherein the guiding base includes a connection wall which is connected to the first, second and third walls, and the connection wall is located corresponding to the first and second slots.

4. The slide assembly as claimed in claim 1, wherein the engaging surface of the engaging body is a recessed area.

5. The slide assembly as claimed in claim 1, further comprising a connection board which includes a pair of engaging slots and an engaging member, the guiding base including a pair of engaging portions corresponding to the engaging slots and an engaging hole corresponding to the engaging member to engage with each other.

6. The slide assembly as claimed in claim 1, further comprising a connection board, an adjusting member and a pivot member, the connection board being fixed to the second slide member and connected to the guiding base, the connection board including a first longitudinal slot, a second longitudinal slot, a fixing hole and a protruding portion, the guiding base including a protrusion, a connection member, a longitudinal groove and a recess, the protrusion extending beyond the first longitudinal slot and the connection member engaged with the second longitudinal slot, the protruding portion engaged with a portion of the recess so that the guiding base is connected to the connection board and moves longitudinally, the adjusting member including an aperture and a spiral recess, the pivot member extending through the aperture of the adjusting member and connected with the fixing hole of the connection board, a portion of the second slide member connected with the longitudinal groove of the guiding base, the protrusion of the guiding base engaged with the spiral recess.

7. The slide assembly as claimed in claim 1, wherein the first slide member has a movable member connected thereto and the second slide member has a first connector, the movable member being linked to move by the first connector of the second slide member, the link member being driven by the movable member to push and turn the positioning member.

8. The slide assembly as claimed in claim 7, wherein the link member is movably connected to the first slide member.

9. The slide assembly as claimed in claim 7, wherein the link member is connected to the movable member.

10. The slide assembly as claimed in claim 1, wherein the link member is connected to the second slide member.

11. The slide assembly as claimed in claim 1, wherein the movable member is connected with a first elastic member which applies a first force in a first direction to the second slide member for the second slide member to be closed automatically relative to the first slide member when the second slide member is retracted relative to the first slide member.

12. The slide assembly as claimed in claim 1, wherein the stored opening force is defined by a second elastic member and a pushing member which is connected with the second elastic member, the second slide member including a second connector, the pushing member engaging with the second connector by a force of the second elastic member for the second slide member to have the stored opening force when the second slide member is retracted relative to the first slide member.

13. The slide assembly as claimed in claim 1, further comprising a third elastic member and a stop which is urged by the third elastic member to lean against an end outside of a longitudinal groove of the guiding base.

14. The slide assembly as claimed in claim 1, further comprising a roller connected to the guiding base, the roller having a rolling surface facing a bottom board of the first slide member.

* * * * *